US006211829B1

(12) United States Patent
Saldell et al.

(10) Patent No.: US 6,211,829 B1
(45) Date of Patent: Apr. 3, 2001

(54) HIGH-EFFICIENT COMPACT ANTENNA MEANS FOR A PERSONAL TELEPHONE WITH A SMALL RECEIVING DEPTH

(75) Inventors: Ulf Saldell, Osterskär; Stefan Lofgren, Stockholm, both of (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/448,486

(22) Filed: Nov. 24, 1999

Related U.S. Application Data

(63) Continuation of application No. 08/875,942, filed on Sep. 22, 1997.

(30) Foreign Application Priority Data

Feb. 8, 1995 (SE) ..... 9500456

(51) Int. Cl.[7] ..... H01Q 1/24
(52) U.S. Cl. ..... 343/702; 455/90
(58) Field of Search ..... 343/702, 895, 343/900; 455/90, 575

(56) References Cited

U.S. PATENT DOCUMENTS

| | | | | |
|---|---|---|---|---|
| 4,868,576 | | 9/1989 | Johnson, Jr. . | |
| 5,343,213 | | 8/1994 | Kottke et al. . | |
| 5,353,036 | * | 10/1994 | Baldry | 343/702 |
| 5,389,938 | * | 2/1995 | Harrison | 343/702 |
| 5,467,097 | * | 11/1995 | Toko | 343/702 |
| 5,600,341 | * | 2/1997 | Thill et al. | 343/895 |
| 5,691,730 | * | 11/1997 | Egashira et al. | 343/702 |
| 5,699,070 | * | 12/1997 | Mischenko et al. | 343/702 |
| 5,717,408 | * | 2/1998 | Sullivan et al. | 343/702 |
| 5,764,191 | * | 6/1998 | Tsuda | 343/895 |
| 5,771,023 | * | 6/1998 | Engblom | 343/702 |

FOREIGN PATENT DOCUMENTS

| | | | |
|---|---|---|---|
| 0716469A1 | 6/1996 | (EP) . | |
| WO94/10720 | 5/1994 | (WO) . | |
| WO94/28593 | 12/1994 | (WO) . | |
| WO 94/28593 * | 12/1994 | (WO) | H01Q/9/30 |

* cited by examiner

*Primary Examiner*—Don Wong
*Assistant Examiner*—James Clinger
(74) *Attorney, Agent, or Firm*—Jacobson, Price, Holman & Stern, PLLC

(57) ABSTRACT

An antenna to be mounted on a personal telephone. The antenna has a helical radiator, an elongated radiator extendable through the helical antenna, and a coupler for activating the extendable elongated radiator, when in extended position. A more compact antenna with less need for receiving depth inside the telephone, is achieved by permitting the extendable elongated radiator, when in a retracted position, to extend at least partially inside the helical radiator. In the extended position the elongated radiator may be coupled to the telephone directly or via the helical antenna.

30 Claims, 2 Drawing Sheets

HIGH-EFFICIENT COMPACT ANTENNA MEANS FOR A PERSONAL TELEPHONE WITH A SMALL RECEIVING DEPTH

This is a Continuation of application Ser. No. 08/875,942 filed Sep. 22, 1997.

FIELD AND BACKGROUND OF THE INVENTION

The invention relates to an antenna means for a radio device provided with a radio transfer or radio communication facility. An antenna means of this kind is for radio communications. Specifically, the invention relates to an antenna means for a device that is mobile or portable. More specifically, the invention relates to an antenna means for a personal (cellular) telephone having a small internal depth for receiving the antenna means. Such a telephone may be a terminal in, e.g., a GSM, an AMPS, or a JDC cellular telephone system.

In a radio device, such as a personal telephone, it is advantageous to achieve an antenna means that has an effective radiation distribution and a high degree of efficiency. These parameters of the antenna means effect its ability to transfer electro-magnetic radiation energy between the radio device, being a first terminal, and a radio communication means. The radio communication means may be a second terminal or a base station, e.g., in any of the above-mentioned cellular telephone systems, with the capacity of establishing a communication connection between the telephone and a second terminal.

The telephone may function in different operating modes. Two different operating modes are a stand-by mode and a call (talk) mode. In these two operating modes there may be different demands upon the antenna means. For example, if the telephone is carried in the stand-by mode, the carrier (a person) may require a small-size and compact configuration of the telephone. An antenna means configuration extending outward from the telephone may be inconvenient in this case.

The reception and transmission performance of an antenna means depends not only on the antenna means itself, but also on a radiation path between the telephone and the radio communication means. Obstacles in the radiation path will lower the antenna performance. In personal telephones it is important that the body of the user does not excessively obstruct the radiation path. Therefore, an antenna means extending sufficiently from the housing of the telephone is required. Demands for performance are higher in the call mode.

PRIOR ART

A type of antenna means that has been used on personal telephones to provide satisfactory performance is disclosed in, e.g., U.S. Pat. No. 4,868,576, WO 94/10720, and WO 94/28593. These antenna means use a helical antenna mounted on a housing of a telephone. Movably through the helical antenna there is provided an elongated radiator that is extendable to increase antenna performance when needed. The disclosed antenna means use extendable antennas with a non-conductive top portion. This requires that the telephones are able to receive all of a radiating portion of the elongated radiator in its retracted position. This creates problems in modern small-size telephones. The above-mentioned documents are incorporated by reference.

OBJECTS AND SUMMARY OF THE INVENTION

The invention is particularly directed toward providing an antenna means that overcomes the deficiencies of the above-mentioned prior art antenna means when an elongated radiator thereof is in a retracted position.

Thus, an object of the invention is to provide a small-size antenna means for a small-size radio communication device. It is desirable to provide an antenna means that is short in overall length compared to the total length of radiator elements combined in the antenna means (at given electrical radiator lengths).

Another object of the invention is to provide an antenna means that occupies a small space inside the radio communication device. For example, as the length of a portable telephone housing is reduced there is a demand for an antenna means with less length inside the housing.

Another object of the invention is to provide an antenna means maintaining high efficiency in order to keep up operating range of a radio communication device and, if the radio communication device is output power controlled, to reduce output power in transmitting from the radio communication device, especially in a battery-powered personal telephone.

Another object of the invention is to provide an antenna means, whose elongated radiator is has an improved ability to resume an original shape after bending, especially when the elongated radiator is retracted in a curved path.

Another object of the invention is to provide an antenna means is not particularly sensitive to a variation in the upper end position of the elongated radiator in its retracted position. Such variations may be caused by variations in manufacturing or by operator handling.

The extendable elongated radiator of the antenna means, when in a retracted position, extends at least partially inside the helical radiator in order to reduce the total length of the antenna means. When mounted on a radio communication device this antenna means does not extend as far into the device as prior art antenna means of this type. The antenna means of the invention also allows a shorter portion of insulating material between the elongated radiator and the knob, thus giving the extendable whip more of the mechanically resilient properties of the elongated radiator. Further, this antenna is suitable for keeping low the sensitivity to variations in the upper end position of the elongated radiator when retracted.

Preferably, in order for the antenna means to function efficiently when the elongated radiator is retracted, the electrical parameters of helical antenna have to diverge from those of helical antenna without influence from an elongated radiator. Firstly, the coupling (coupling mismatch) between the helical antenna and the retracted elongated radiator is minimized, by increasing the ratio of the diameter of the helical antenna (within design limits) to the diameter of the elongated radiator, as well as by selecting a suitable material for the dielectric body. Secondly, the length of the helical antenna of the invention is adapted in order to achieve satisfactory resonance in spite of the retracted elongated radiator. Other parameter alterations, such as other geometrical changes, especially arranging the elongated radiator to co-extend only partially with the helical radiator, are possible and advantageous for compensating the capacitance and inductance introduced on the helical antenna. A matching unit may also be used to improve performance of the radiators.

In case a conductive sleeve is used as conventionally to fasten the helical radiator and the movable elongated radiator onto the housing of the radio communication device, it is advantageous to arrange the sleeve so that a capacitance formed between the sleeve and the elongated radiator compensates for a mainly inductive coupling between the lower and middle portion of the helical radiator and elongated radiator, in order to increase impedance between the elongated radiator and helical radiator, hence reducing the coupling between them.

There may advantageously be arranged means inside the housing of the radio communication device to limit the influence of the elongated radiator on the helical radiator.

Preferably, the retracted radiator may be coupled to signal ground a distance of approximately one quarter of a wavelength from said a feed point, essentially being the conductive sleeve, of said helical radiator.

The antenna means of the invention is advantageously used where a prior art antenna of the above-described type is desired, but the receiving depth of the radio communication device is too small.

It is possible to arrange the antenna means according to the invention such that the extendable elongated radiator extends to a position wherein it is coupled galvanically or inductively capacitively via the helical antenna to the circuitry of the radio communication device. In this case the elongated radiator may extend partially inside the helical radiator.

DESCRIPTION OF PREFERRED EMBODIMENTS

Figure 1:
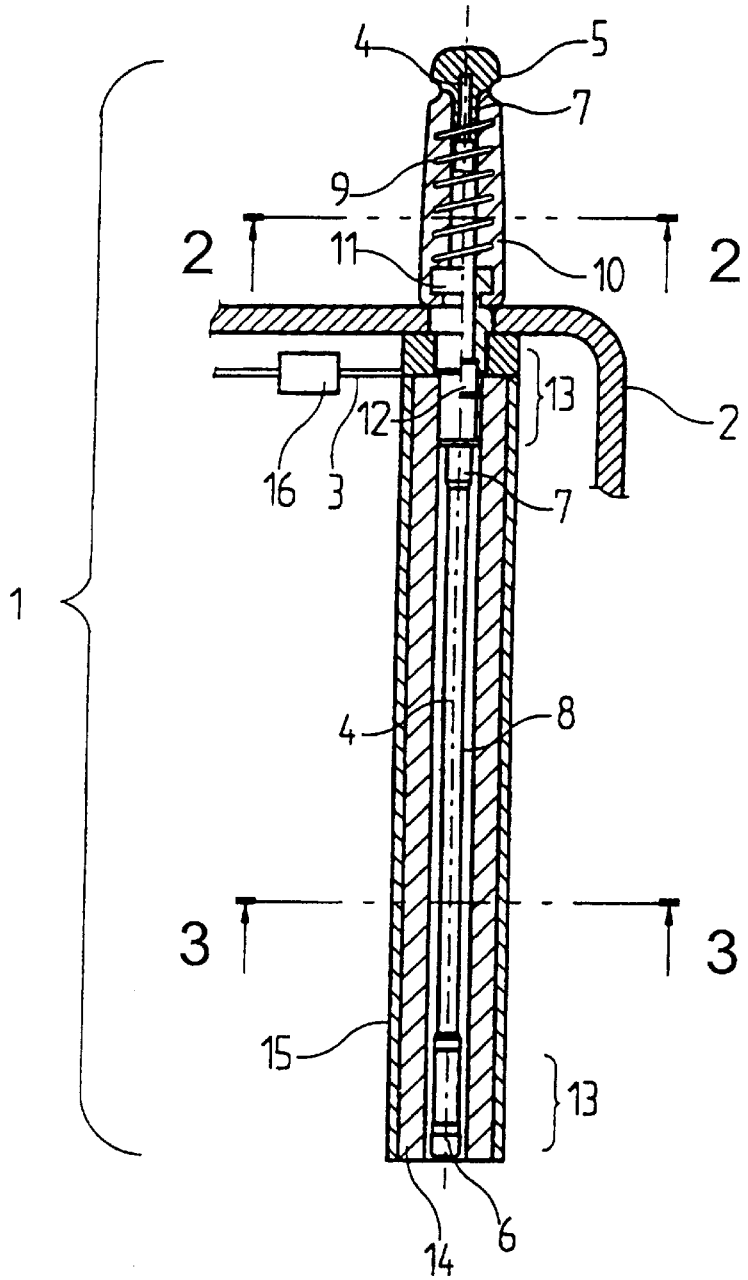
FIG. 1 shows, in partly cross-sectional side view, an antenna means for a radio communication device according to one embodiment of the invention, comprising mainly an extendable elongated radiator (in retracted position) and a helical radiator.

With reference to FIG. 1, an antenna means 1 is mounted to a housing 2 of a radio communication device which includes electrical circuitry (not shown). The antenna means 1 is coupled via a conductor 3 and, optionally, a tuning unit 16 to the electrical circuitry. The tuning unit matches the impedance of the antenna means to the characteristic impedance of the electrical circuitry. The antenna means 1 comprises a first part being movable and a second part being fixed in relation to the housing.

The first part of the antenna means is constituted by an axially extendable and retractable conductive elongated radiator (actively radiating portion of an antenna whip) 4 provided with a dielectric knob 5 at an upper end, a lower conductive part 6 at a lower end, and a dielectric casing 7, 8 extending from the knob 5 to the lower conductive part 6. The second part of the antenna means consists of a helical radiator 9, a dielectric body 10, a conductive sleeve 11, and a coupling member 12. The helical radiator 9 is axially aligned with and connected in one end to the conductive sleeve 11.

In this embodiment the dielectric body 10 encloses and is fixed to the helical radiator 9 and a first end of the conductive sleeve 11. A second end of the conductive sleeve 11 is led into the housing 2 from the outside. Further, the conductive sleeve 11 is fixed to the housing 2 making the helical radiator extend perpendicularly from it. Axially through the helical radiator 9, the dielectric body 10, the conductive sleeve 11, and the coupling member 12 there is provided a hole occupied by the elongated radiator 4. In this way a movement of the elongated radiator 4 through the helical radiator 9 is restricted by the knob 5 and the dielectric body 10 and the lower conductive part 6 and the conductive sleeve 11 in an extended and a retracted position, respectively. In this preferred embodiment the upper portion of the elongated radiator 4, when in its retracted position, extends throughout the helical radiator 9.

In combination with the coupling member 12, the lower conductive part 6 of the elongated radiator 4 and the conductive sleeve 11 provide a switching means 12. Thus, in the extended position the elongated radiator 4 is coupled via the conductor 3 and in parallel with the helical radiator to the circuitry of the radio communication device, while the helical radiator 9 is coupled to the circuitry in the retracted position.

The elongated radiator 4 and the helical radiator 9 is an actively radiating portion of the first movable and the second fixed part, respectively, of the antenna means 1.

Inside the housing 2 there is provided a cylindrical arrangement surrounding the elongated radiator when retracted, consisting of a dielectric guiding tube 14 surrounded by a conductive tube 15 (or conductive interior of radio communication device) connected to signal ground of the circuitry. Alternatively the conductive tube 15 may have an open and/or varying profile not fully enclosing the elongated radiator 4.

Figure 2:
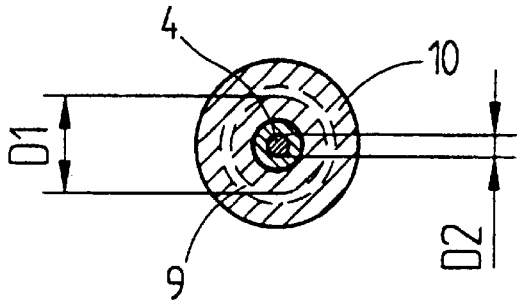
FIG. 2 shows, in cross-section A—A marked in FIG. 1, a bottom view including mainly dimensions of the elongated radiator and the helical radiator externally of the radio communication means.

With reference to FIG. 2 the helical radiator 9 has a (inner) diameter D1, and a portion of the elongated radiator 4, situated inside the helical radiator 9 in the retracted position, has a (outer) diameter D2. The degree of coupling between the antennas in the retracted position is a function of these diameters D1, D2. A capacitance C1 between the helical radiator 9 and the elongated radiator 4 is mainly a function of ln(D2/D1). The capacitance C1 is also dependent on, e.g., the number of turns and the wire thickness in the helical winding.

Figure 3:
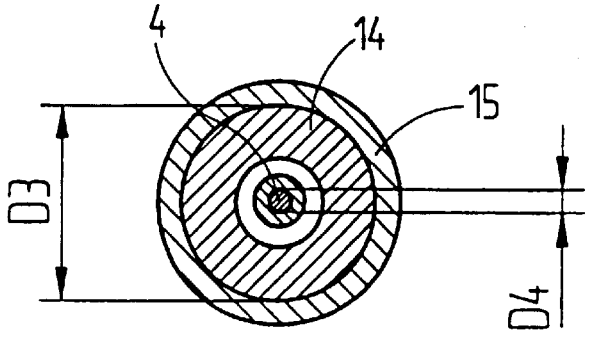
FIG. 3 shows, in cross-section B—B marked in FIG. 1, a bottom view including mainly radial dimensions of the elongated radiator and the helical radiator internally of the radio communication means.

With reference to FIG. 3 the conductive tube 15 has a (inner) diameter D3, and a portion of the elongated radiator 4, situated inside the conductive tube 15 in the retracted position, has a (outer) diameter D4. The degree of coupling between the elongated radiator in the retracted position and the conductive tube 15 is a function of these diameters D3, D4. A capacitance C2 between the elongated radiator 4 and the conductive tube 15 is mainly a function of ln(D4/D3).

In this embodiment, a capacitance introduced on the helical radiator 9 by the elongated radiator 4 in its retracted position is dependent on the capacitance C1 and the capacitance C2, which work as a coupled capacitors between the helical radiator 9 and a signal ground of the electrical circuitry. Both of these capacitances are held low, which leads to a low influence only on the helical radiator 9 from the elongated radiator 4 in its retracted position.

Figure 4:
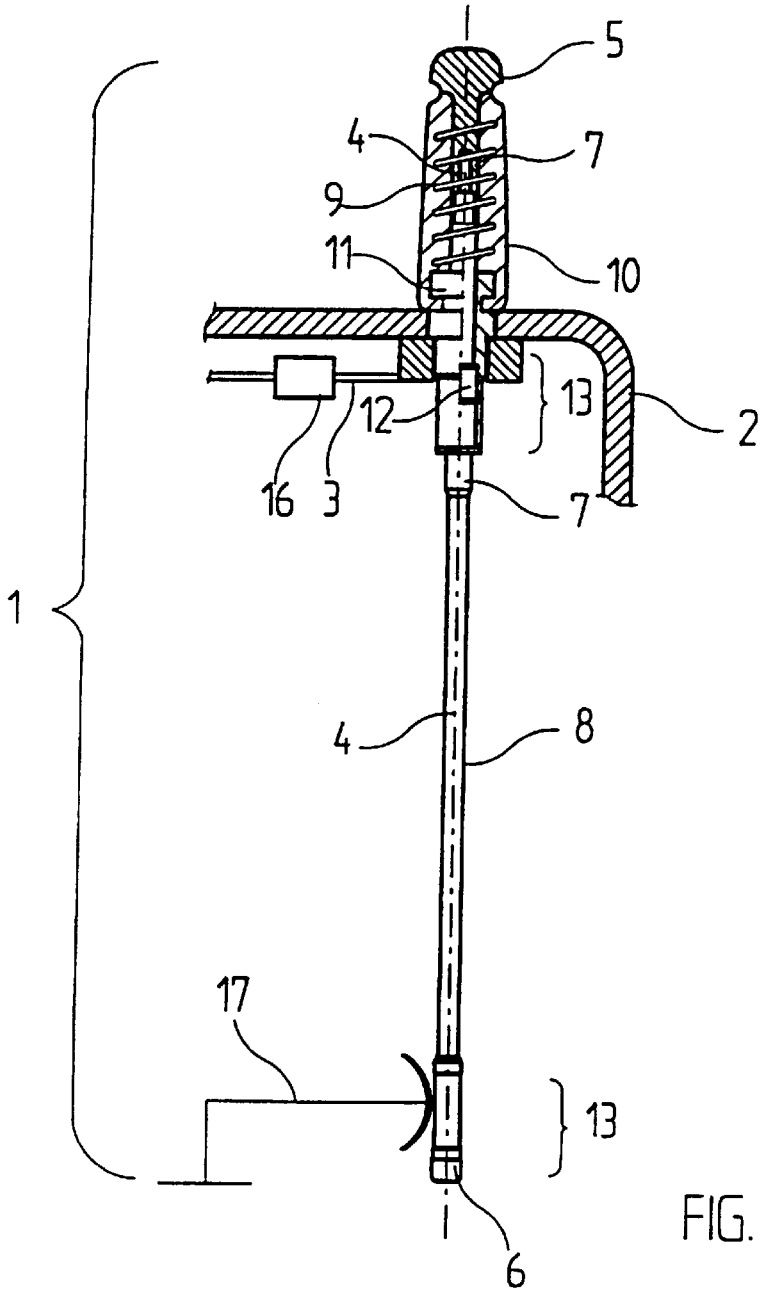
FIG. 4 shows, in partly cross-sectional side view, an antenna means for a radio communication device according to another embodiment of the invention, comprising mainly an extendable elongated radiator (in retracted position) and a helical radiator.

FIG. 4 shows an embodiment of the invention with a configuration similar of that shown in FIGS. 1–3. Therefore, it will not be described in such great detail. In this case the retracted elongated radiator does not extend as far into the helical radiator, which effectively reduces the influence between the radiators, due to present variations in capacitance and inductance between the radiators along their distance of coextension. Moreover, the retracted elongated radiator is provided with a galvanical ground connection via a coupling means 17 at about a quarter of a wavelength from a feed point of the helical radiator, thus again increasing the impedance between the two radiators. If the length of the retracted portion of elongated radiator is not approximately one quarter of a wavelength the ground connection could be omitted.

Although the features of a partial extension only of the elongated radiator, when in retracted position, into the helical radiator, and a ground coupling means are described above in relation to one embodiment, it is evident to a skilled person that a combination would be possible of any of these features and other features disclosed herein.

Parts List

1. Antenna means
2. Housing (of radio communication device)
3. Conductor
4. Elongated radiator
5. Knob (of elongated radiator)
6. Lower conductive part (of elongated radiator)
7. Dielectric casing (of elongated radiator, upper part)
8. Dielectric casing (of elongated radiator, lower part)
9. Helical radiator
10. Dielectric body
11. Conductive sleeve
12. Coupling member
13. Switching means
14. Dielectric guiding tube
15. Conductive tube
16. Tuning unit
17. Coupling means

What is claimed is:

1. An antenna device for a radio communication device comprising:

an essentially cylindrically configured radiator surrounded by dielectric material for minimizing coupling, said essentially cylindrically configured radiator mounted on and coupled to said radio communication device;

an extendable elongated radiator movable to an extended position and to a retracted position;

a switching device for coupling said extendable elongated radiator, when in said extended position, to said radio communication device;

said essentially cylindrically configured radiator having an opening, and said opening extending axially through said essentially cylindrically configured radiator;

said extendable elongated radiator being movably mounted through said opening of said essentially cylindrically configured helical radiator; wherein said extendable elongated radiator, when in the retracted position, extends inside said essentially cylindrically configured radiator in order to reduce a total length of said antenna device, and at least one of the properties length, geometry and surrounding dielectric material of said essentially cylindrically configured radiator is selected so as to obtain a compensating capacitive/inductive load on the essentially cylindrically configured radiator at least partially compensating a first capacitive/inductive load on the essentially cylindrically configured radiator resulting from the presence of the elongated radiator inside said essentially cylindrically configured radiator in the retracted position.

2. The antenna device according to claim 1, wherein said radio communication device is provided with a housing, said antenna device mounted thereto and said elongated radiator, when in the retracted position, extends inside said essentially cylindrical configured radiator in order to reduce a total extension of said antenna device into said housing.

3. The antenna device according to claim 1, wherein a depth of penetration by said elongated radiator, when in the retracted position, into said essentially cylindrically configured radiator is selected, with regard to a performance of said essentially cylindrically configured radiator, such that at least one of the following is attained:

said performance is substantially maximized, a variation in said performance, when varying said depth of penetration, is substantially minimized.

4. The antenna device according to claim 3, wherein said depth of penetration is 50%–90% of an axial length of said essentially cylindrically configured radiator.

5. The antenna device according to claim 1, wherein a capacitance formed between a conductive sleeve and said elongated radiator extending through the conductive sleeve is dimensioned so as to compensate for a first capacitive/inductive load introduced on said essentially cylindrically configured radiator by said elongated radiator in the retracted position.

6. The antenna device according to claim 2, wherein said essentially cylindrically configured radiator is arranged outside said housing and a substantially cylindrical conductor is arranged to surround said elongated radiator inside said housing and to control a second capacitance introduced inside said housing on said elongated radiator in the retracted position.

7. The antenna device according to claim 6, wherein said elongated radiator and said substantially cylindrical conductor are separated by at least one dielectric material.

8. The antenna device according to claim 1, further comprising a lower portion of said extendable elongated radiator, when in the retracted position, is coupled capacitively by a coupling device to a signal ground of said radio communication device.

9. The antenna device according to claim 8, wherein said coupling device comprises a lower portion of a dielectric guiding tube.

10. The antenna device according to claim 9, wherein said lower portion of said dielectric guiding tube has a thickness greater than a remaining portion of said guiding tube.

11. The antenna device according to claim 1, wherein a lower portion of said extendable elongated radiator, when in the retracted position, is coupled galvanically by a coupling device to a ground potential of said radio communication device.

12. The antenna device according to claim 9, wherein said lower portion is coupled to said signal ground at a distance of approximately one quarter of a wavelength from a feed point of said essentially cylindrically configured radiator.

13. The antenna device according to claim 1, wherein said extendable elongated radiator, when in said extended position, extends inside said essentially cylindrically configured radiator.

14. The antenna device according to claim 1, wherein said extendable elongated radiator, when in said extended position, extends partially inside or adjacent to said essentially cylindrically configured radiator; and said switching device couples said elongated radiator via said essentially cylindrically configured radiator to said radio communication device.

15. The antenna device according to claim 13, wherein said switching device establishes a galvanical coupling or a capacitive/inductive coupling between said elongated radiator and said radio communication device.

16. An antenna device for a radio communication device comprising:

an essentially cylindrically configured radiator surrounded by dielectric material for minimizing coupling, said essentially cylindrically configured radiator mounted on and coupled to said radio communication device;

an extendable elongated radiator movable to an extended position and to a retracted position;

a switching device for coupling said extendable elongated radiator, when in said extended position, to said radio communication device;

said essentially cylindrically configured radiator having an opening, and said opening extending axially through said essentially cylindrically configured radiator;

said extendable elongated radiator being movably mounted through said opening of said essentially cylindrically configured helical radiator; wherein said extendable elongated radiator, when in the retracted position, extends inside said essentially cylindrically configured radiator in order to reduce a total length of said antenna device, which extension defines a penetration depth, and at least one of the properties length, geometry and surrounding dielectric material of said essentially cylindrically configured radiator and penetration depth of the extendable elongated radiator is selected so as to obtain a compensating capacitive/inductive load on the essentially cylindrically configured radiator at least partially compensating a first capacitive/inductive load on the essentially cylindrically configured radiator resulting from the presence of the elongated radiator inside said essentially cylindrically configured radiator in the retracted position.

17. The antenna device according to claim 16 wherein said radio communication device is provided with a housing, said antenna device mounted thereto and said elongated radiator, when in the retracted position, extends inside said essentially cylindrical configured radiator in order to reduce a total extension of said antenna means into said housing.

18. The antenna device according to claim 16, wherein the depth of penetration by said elongated radiator, when in the retracted position, into said essentially cylindrically configured radiator is selected, with regard to a performance of said essentially cylindrically configured radiator, such that at least one of the following is attained:

said performance is substantially maximized, a variation in said performance, when varying said depth of penetration, is substantially minimized.

19. The antenna device according to claim 16 wherein said depth of penetration is 50%–90% of axial length of said essentially cylindrically configured radiator.

20. The antenna device according to claim 16, wherein a capacitance formed between a conductive sleeve and said elongated radiator extending through the conductive sleeve is dimensioned so as to compensate for a first capacitive/inductive load introduced on said essentially cylindrically configured radiator by said elongated radiator in the retracted position.

21. The antenna device according to claim 17, wherein said essentially cylindrically configured radiator is arranged outside said housing and a substantially cylindrical conductor is arranged to surround said elongated radiator inside said housing and to control a second capacitance introduced inside said housing on said elongated radiator in the retracted position.

22. The antenna device according to claim 21, wherein said elongated radiator and said substantially cylindrical conductor are separated by at least one dielectric material.

23. The antenna device according to claim 16, further comprising a lower portion of said extendable elongated radiator, when in the retracted position, is coupled capacitively by a coupling device to a signal ground of said radio communication device.

24. The antenna device according to claim 18, wherein said coupling device comprises a lower portion of a dielectric guiding tube.

25. The antenna device according to claim 19, wherein said lower portion of said dielectric guiding tube has a thickness greater than a remaining portion of said guiding tube.

26. The antenna device according to claim 16, wherein a lower portion of said extendable elongated radiator, when in the retracted position, is coupled galvanically by a coupling device to a ground potential of said radio communication device.

27. The antenna device according to claim 24, wherein said lower portion is coupled to said signal ground at a distance of approximately one quarter of a wavelength from a feed point of said essentially cylindrically configured radiator.

28. The antenna device according to claim 16, wherein said extendable elongated radiator, when in said extended position, extends inside said essentially cylindrically configured radiator.

29. The antenna device according to claim 16, wherein said extendable elongated radiator, when in said extended position, extends partially inside or adjacent to said essentially cylindrically configured radiator; and said switching device couples said elongated radiator via said essentially cylindrically configured radiator to said radio communication device.

30. The antenna device according to claim 28, wherein said switching device establishes a galvanical coupling or a capacitive/inductive coupling between said elongated radiator and said radio communication device.

* * * * *